United States Patent [19]

Hansson

[11] Patent Number: 4,558,539

[45] Date of Patent: Dec. 17, 1985

[54] PNEUMATIC ROTARY GRINDING TOOL

[75] Inventor: Gunnar C. Hansson, Stockholm, Sweden

[73] Assignee: Atlas Copco Aktiebolag, Nacka, Sweden

[21] Appl. No.: 623,387

[22] Filed: Jun. 22, 1984

[30] Foreign Application Priority Data

Jun. 27, 1983 [SE] Sweden ..... 8303653

[51] Int. Cl.[4] ..... B24B 23/00; B24B 55/04

[52] U.S. Cl. ..... 51/170 R; 51/134.5 F; 51/268

[58] Field of Search ..... 51/170 R, 170 T, 170 PT, 51/170 MT, 268, 134.5 F

[56] References Cited

U.S. PATENT DOCUMENTS

| | | | |
|---|---|---|---|
| 2,149,645 | 3/1939 | Sittert | 51/170 T |
| 2,422,733 | 6/1947 | Jimerson | 51/134.5 F |
| 4,103,460 | 8/1978 | Law | 51/134.5 F |

*Primary Examiner*—Roscoe V. Parker

*Attorney, Agent, or Firm*—Frishauf, Holtz, Goodman & Woodward

[57] ABSTRACT

A pneumatic rotary grinding tool in which the motor unit (15) is displaceable between a rear, operative position and a forward, dislocated position. A safety guard (18) mounted on the tool housing (10) forms an axial support for the motor unit (15) to keep the latter in a rear, operative position, thereby maintaining a seal (23–25) in active position to prevent supplied pressure air from passing directly from the supply passage (12) to the exhaust passage (35) without energizing the motor unit (15). When the safety guard 18 is removed the motor unit (15) is dislocated by the air pressure to a forward position in which the seal (23–25) is rendered inactive and allows supplied pressure air to pass directly from the air supply passage (12) to the exhaust passage (35). A stepped diameter sleeve (30) serves as a distance piece between the motor unit (15) and the safety guard (18) both when the latter is properly mounted on the housing (10) and between a shoulder (28) on the motor unit (15) and an oppositely directed shoulder (27) in the housing (10) as the motor unit (15) is dislocated.

7 Claims, 2 Drawing Figures

PNEUMATIC ROTARY GRINDING TOOL

BACKGROUND OF THE INVENTION

This invention relates to a pneumatic rotary grinding tool in which pressure air supply and exhaust passages in the tool housing communicate with air inlet and outlet ports on a motor unit, and which comprises a safety guard detachably mounted on the housing in a protective disposition relative to a grinding wheel attached to the motor spindle.

The invention intends to solve the problem of how to prevent use of a grinding tool of the above type when the safety guard is not properly fitted. Using the tool without having the safety guard fitted means an increased risk of injury for the operator and other people in the vicinity of the tool, because there is always a potential danger involved in the use of a rotary grinding tool. As is well known a grinding wheel exposed to excessive inertia forces at overspeed conditions might suddenly burst into a number of most dangerous high speed particles.

A correctly designed safety guard properly mounted on the tool offers a good protection against such a danger.

Another, more obvious potential danger of a rotary grinding tool is of course the tremendous cutting ability of a normally running grinding wheel which could cause severe casualties if, for example, the tool slips and the operator looses control of the tool. A safety guard partly surrounding the grinding wheel is effective to some extent in preventing accidents of this type too.

A previously suggested solution to this problem is described in U.S. Pat. No. 4,103,460. In the rotary grinding tool shown in this patent the safety guard forms an end closure for the tool housing. Thereby, the safety guard not only serves as a closure for a pressure air relief opening through which the pressure air supply passage in the tool housing is connectable to the atmosphere, but forms the only limitation to axial displacement of the motor unit. This means that should an attempt be made to activate the tool by opening the throttle valve when no safety guard is mounted there is a great risk that the entire motor unit will "disassociate itself" from the housing. Accordingly, this known power tool brings a new problem, namely, that if the tool is unintentionally activated the motor is expelled from the housing by the air pressure. This might be hazardous to the operator who runs the risk of being hit and hurt by the motor unit.

Linked to this direct safety problem is a secondary safety problem which may arise if the motor-speed governor unit is expelled from the housing and got damaged and/or exposed to dirt. Damage and/or dirt may jeopardize a correct speed governor operation and, thereby, cause a hazardous overspeed.

The above problems are solved by the power tool design according to our invention.

A preferred embodiment of the invention is below described in detail with reference to the accompanying drawing.

DETAILED DESCRIPTION

Figure 1:
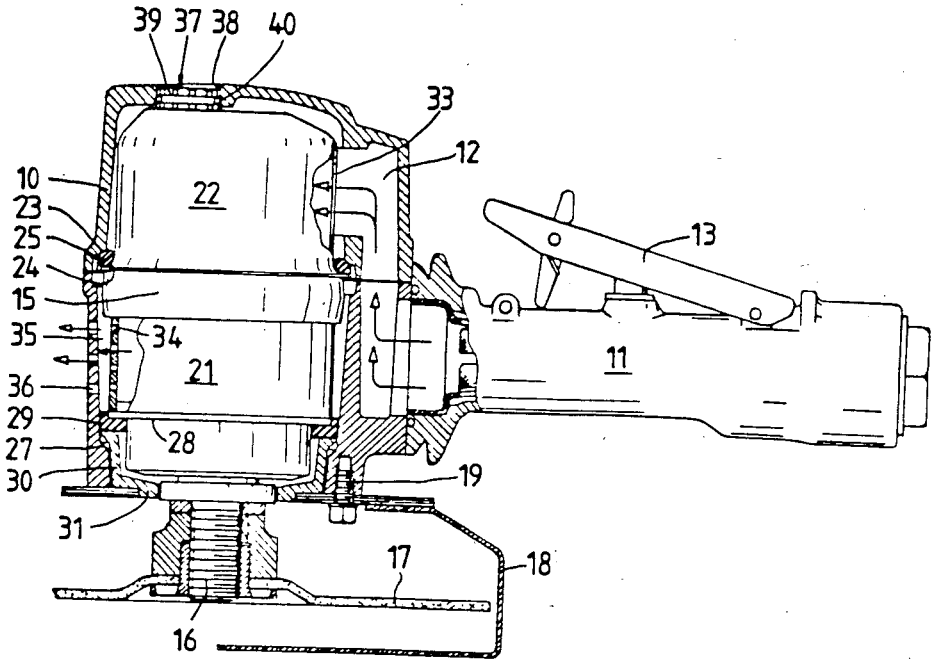
FIG. 1 shows, partly in section, a side view of a pneumatic grinding tool according to the invention, including a properly mounted safety guard.

The grinding tool shown in the drawing figures comprises a housing 10, a handle 11 rigidly attached to the housing 10 and forming a part of a pressure air supply passage 12, a throttle valve (not shown) located in the handle 11 and controlled by a lever 13, and a motor unit 15 mounted in the housing 10 and driving an output spindle 16. In FIG. 1, the output spindle 16 carries a grinding wheel 17 of the cutting type.

A safety guard 18 is rigidly attached to the housing 10 by means of screws 19. The safety guard 18 is mounted in a protective disposition relative to the grinding wheel 17 which means that the safety guard 18 partly surrounds the latter.

Apart from a pneumatic vane motor 21 the motor unit 15 comprises a speed control means (not shown in detail) coupled to the motor 21 and enclosed in a cup-shaped shell 22. The speed control means comprises a speed governor and in some cases also an overspeed responsive shut-off valve. Since the speed control means does not form any part of this invention a detailed description thereof is not provided.

Figure 2:
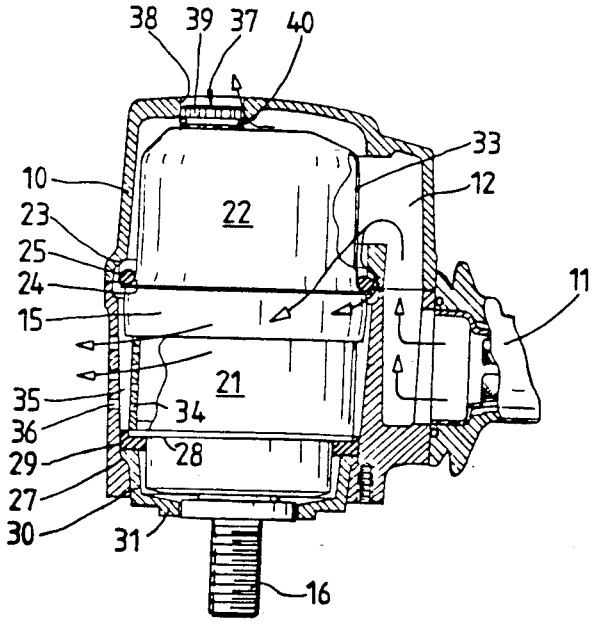
FIG. 2 shows the tool in FIG. 1 with the safety guard and grinding wheel removed.

The motor unit 15 is axially displaceable in the housing 10 between a rear, operative position (illustrated in FIG. 1) and a forward, dislocated and inoperative position (illustrated in FIG. 2). The rear, operative position is defined by an annular forwardly facing shoulder 23 in the housing 10 and an oppositely directed shoulder 24 on the motor unit 15. Between these shoulders 23, 24 there is inserted a seal ring 25 by which the housing 10 is divided into two parts.

The forward, dislocated position of the motor unit 15 is defined by a rearwardly facing annular shoulder 27 in the housing 10 and an opposite shoulder 28 on the motor unit 15. Between these two shoulders 27, 28 however, there is inserted a resilient buffer ring 29 and a stepped diameter support sleeve 30. The latter is formed at its forward end with a collar 31 which is arranged to locate the safety guard 18 in a concentric relationship with the motor spindle 16.

The support sleeve 30 is axially displaceable relative to the housing 10 and serves as a distance member between the motor unit 15 and the safety guard 18 when the latter is properly mounted on the housing 10.

As mentioned above, the housing 10 incorporates an air supply passage 12 which extends into the rear part of housing 10. The motor unit 15 comprises an air inlet port 33 and air outlet ports 34. In the front part of the housing 10 there is an exhaust passage 35 which via openings 36 communicates with the atmopshere. The exhaust passage 35 is formed by an annular space left between the motor unit 15 and the housing 10.

At its rear end the motor unit 15 is formed with a small diameter extension 37 which comprises with an aperture 38 in the housing 10. The aperture 38 is of circular cross section whereas the motor unit extension 37 is formed with a number of axially directed flats or grooves 39. The extension 37 carries a circular seal ring 40 which is arranged to sealingly cooperate with the wall of the aperture 38 as the motor unit 15 occupies its rear operative position in the housing 10.

As illustrated in FIG. 1, the safety guard 18, when properly mounted on the housing 10 by means of the screw 19 transfers an axial clamping force to the support sleeve 30. This means that the motor unit 15 is firmly kept in its rear operative position, resting on one side on the buffer ring 29 and on the other side on the seal ring 25. The latter is axially clamped between the oppositely facing shoulders 23, 24 and seals off the rear part of the housing 10 from the front part thereof. In this position, the seal ring 40 on the rear motor unit extension 37 cooperates with the aperture 38 in the housing 10 and seals off the housing 10 from the atmosphere.

When in this condition the tool is activated by pressing the throttle valve lever 13. Pressure air enters the supply passage 12 and reaches the motor unit 15 through inlet port 33. (See arrows.) Since the rear part of the housing 10 is sealed off by rings 25 and 40 full pressure is built up therein and the motor unit 15 starts rotating the output spindle 16 and the grinding wheel 17 with full power. Exhaust air leaves the motor through outlet ports 34 and is conducted to the atmosphere via exhaust passage 35 and openings 36. (See arrows.).

As illustrated in FIG. 2, the operation conditions of the tool are quite different when no safety guard is fitted. Since there is no axial support for the distance sleeve 30 there is no clamping force to keep the motor unit 15 in the rear operative position and to maintain the seal ring 25 in active position between the opposite shoulders 23, 24. This means that if and when pressure air is supplied through passage 12 the motor unit will be disclosed forwards by the air pressure, and may be also by gravity, and will occupy the position shown in FIG. 2. Due to the fact that the seal ring 25 is no longer effective in separating the rear part of the housing 10 from the front part thereof, pressure air will pass directly from the supply passage 12, past the seal ring 25 and out through the exhaust passage 35 and openings 36. (See arrows.). There will be practically no pressure build-up in the rear part of the housing 10, which means that hardly no air will pass through the motor unit 15. A very slow and powerless rotation of the spindle 16 might occur but that would be harmless to the operator even if a grinding wheel were attached to the spindle 16.

It is important to notice, however, that although no safety guard is fitted and, accordingly, there is no axial support for the motor unit 15 in the rear operative position, the motor unit 15 is prevented from being expelled from the housing 10 by the interengagement of the support sleeve 30 and the abutment shoulder 27 in the housing 10. This means that the motor unit 15 by means of its forwardly facing shoulder 28, buffer ring 29 and the support sleeve 30 is positively limited in its forward directed movement. Accordingly, the motor unit 15 will always stay inside the housing 10 and there will be no danger to people and/or equipment due to the motor unit being dislocated.

A small fault indicating air stream is accomplished at the rear end of the tool housing 10 when seal ring 40 is moved out of engagement with the wall of aperture 38. Instead, pressure air may escape into the atmosphere via the flats or grooves 39 on the motor unit extension 37. The joint cross section of the flats or grooves 39, however, is just a fraction of the total cross section of the extension 37, and the air flow through this limited passage would not alone be large enough to prevent pressure build-up in the rear part of the housing 10 and activation of the motor unit 15.

I claim:

1. A pneumatic rotary grinding tool comprising a housing (10), a motor unit (15) mounted in said housing (10) and driving an output spindle (16), a pressure air supply passage (12) communicating with an air inlet port means (33) on the motor unit (15), an exhaust passage (35) communicating with an air outlet port means (34) on the motor unit (15), and a safety guard (18) detachably mounted on the housing (10) in a protective disposition relative to a grinding wheel (17) attached to the output spindle (16), characterized in that a seal means (23–25) is arranged between the motor unit (15) and the housing (10) to seal off said air supply passage (12) from said exhaust passage (35), the motor unit (15) being displaceable in the housing (10) between a rear operative position in which said seal means (23–25) is maintained in its active position and a forward dislocated position in which said seal means (23–25) is rendered inactive, said safety guard (18) being arranged to support the motor unit (15) in said rear operative position when properly mounted on the housing (10).

2. Grinding tool according to claim 1, wherein the rear operative position of the motor unit (15) is defined by said seal means (23–25), and wherein the housing (10) comprises an abutment shoulder (27) defining the forward, dislocated position of the motor unit (15).

3. Grinding tool according to claim 1, wherein a distance means (30) is disposed between the safety guard (18) and the motor unit (15) to support the latter relative to the safety guard (18) is said rear operative position.

4. Grinding tool according to claim 3, wherein the housing (10) comprises an abutment shoulder (27) defining the forward, dislocated position of the motor unit (15), and said distance means (30) is arranged also to support the motor unit (15) relative to said abutment shoulder (27) in said forward dislocated position.

5. Grinding tool according to claim 3, wherein said distance means (30) comprises a stepped diameter sleeve element arranged in a coaxial disposition relative to the motor unit (15).

6. Grinding tool according to claim 1, wherein the housing (10) has an aperture (38) therein by which the air supply passage (12) is connectable to the atmosphere, the motor unit (15) is provided with a closure means (37–39) which is arranged to fully cover said aperture (38) as the motor unit (15) occupies its rear operative position and which in the forward dislocated position of the motor unit (15) leaves a fractional part of said aperture (38) uncovered.

7. Grinding tool according to claim 4, wherein said distance means (30) is a stepped diameter sleeve element arranged in a coaxial disposition relative to the motor unit (15).

* * * * *